US010329766B1

(12) United States Patent
Kollinger

(10) Patent No.: US 10,329,766 B1
(45) Date of Patent: Jun. 25, 2019

(54) STRUCTURAL CROSS BRACING SYSTEM

(71) Applicant: Michael Kollinger, Salmon Arm (CA)

(72) Inventor: Michael Kollinger, Salmon Arm (CA)

( * ) Notice: Subject to any disclaimer, the term of this patent is extended or adjusted under 35 U.S.C. 154(b) by 0 days.

(21) Appl. No.: 15/855,978

(22) Filed: Dec. 27, 2017

(51) Int. Cl.
*E04C 3/02* (2006.01)

(52) U.S. Cl.
CPC ..... *E04C 3/02* (2013.01); *E04C 2003/026* (2013.01)

(58) Field of Classification Search
CPC ..... E04C 3/02; E04C 2003/026
See application file for complete search history.

(56) References Cited

U.S. PATENT DOCUMENTS

| | | | | |
|---|---|---|---|---|
| 862,973 | A * | 8/1907 | Kahn | E04C 3/02 52/694 |
| 1,656,741 | A | 1/1928 | Lane | |
| 1,729,741 | A * | 10/1929 | Heltzel | E04C 3/02 52/695 |
| 1,822,332 | A * | 9/1931 | Bates, Jr. | E04C 3/02 52/695 |
| 2,089,023 | A | 8/1937 | Hahn | |
| 2,204,566 | A * | 6/1940 | Buelow | E04C 3/02 52/377 |
| 2,565,875 | A | 8/1951 | Musacchia | |
| 2,865,059 | A | 12/1958 | Scriven | |
| 4,004,334 | A * | 1/1977 | Greenley | B21D 47/02 29/432 |
| 4,246,736 | A | 1/1981 | Kovar et al. | |
| 4,541,218 | A | 9/1985 | Gottlieb | |
| 4,794,746 | A * | 1/1989 | Ramer | E04B 5/12 52/695 |
| D340,856 | S | 11/1993 | McHugh | |
| 5,301,486 | A * | 4/1994 | Taylor | E04B 5/12 52/638 |
| 5,893,253 | A | 4/1999 | Lutz, III | |
| 5,937,608 | A * | 8/1999 | Kucirka | E04B 5/12 52/105 |
| D595,115 | S | 6/2009 | Royer | |
| 8,966,856 | B2 * | 3/2015 | Groenesteyn | E04C 3/18 52/643 |
| 9,290,926 | B2 * | 3/2016 | Sidhu | E04B 1/2612 |
| 2007/0246297 | A1 | 10/2007 | Gerlich et al. | |

(Continued)

FOREIGN PATENT DOCUMENTS

| | | | |
|---|---|---|---|
| CA | 2730837 | A1 | 8/2011 |
| WO | 2011057377 | A1 | 5/2011 |
| WO | 2013120165 | A1 | 8/2013 |

*Primary Examiner* — Jeanette E Chapman
(74) *Attorney, Agent, or Firm* — David Guerra

(57) ABSTRACT

The present technology is a bracing system capable of reinforcing and distributing loads between spaced structural members. The system includes multiple similar bracing units each including a connection member featuring a connection section and a pair of connection arms, and an end bracket located at an end of each of the connection arms. The end brackets of a first bracing unit are mounted to a same first side of spaced apart structural members, and the end brackets of a second bracing unit are mounted to a same second side of the structural members, with the first and second sides being opposite each other. One of the bracing units is inverted such that the connection sections of the bracing units are adjacent each other and located in an interior space defined between the structural members.

17 Claims, 8 Drawing Sheets

(56) References Cited

U.S. PATENT DOCUMENTS

| | | | | |
|---|---|---|---|---|
| 2014/0311082 | A1 | 10/2014 | Sidhu | |
| 2014/0318073 | A1* | 10/2014 | Sidhu | E04B 1/2612 52/702 |
| 2014/0352252 | A1 | 12/2014 | Sidhu et al. | |
| 2015/0345133 | A1* | 12/2015 | Sidhu | E04B 5/12 52/167.1 |

* cited by examiner

STRUCTURAL CROSS BRACING SYSTEM

BACKGROUND OF THE INVENTION

Field of the Invention

The present invention relates to a structural cross bracing system for use in connection with reinforcing and distributing loads between spaced structural members.

Description of the Prior Art

The use of structural beam bracings or bridges is known in the prior art, notwithstanding the fact that numerous patents have been granted for beam bracing and bridging. It is still common practice in building construction to use wooden or metal beams to form walls, ceilings, roof substructures, floors and the like. The beams used in construction can be, but not limited to, joists, trusses, studs, I-beams, channeled beams, solid beams and the like. In applying these, the universal practice among builders is to secure the beams to other structural members, foundations or paneling using nails, screws or other fasteners.

After installation of the beams, it is also known to use two diagonally placed wooden or metal members between adjacent and parallel beams. These diagonal members are commonly referred to as a herringbone strut. Herringbone struts connect a top side or chord of a first beam to a bottom side or chord of an adjacently spaced apart second beam, with a second strut connecting a bottom side or chord of the first beam to a top side or chord of the second beam. Essentially creating a diagonal brace configuration between the beams.

This practice, along with prior art that improves upon this practice, have been found impracticable and deficient in absorbing and distributing dynamic and/or static loads applied to the beams, for example with loads associated with earthquakes, wind, tidal forces, impact by objects, weight redistribution within or on the building, and other loading situations. A further disadvantage to these known beam braces is the difficulty in installing them since access to the bottoms and tops of the beams is required for the securing of each brace.

It can be appreciated that when the beams are subjected to torsional loading, the struts or braces on one side of the beam are subjected to opposite loads. During torsional loading of the beam, a tensile load is created at a location where a first brace abuts the top chord of the beam, and a compression load is created at a location where a second brace abuts the top chord of the beam on a side opposite the first brace. One could suggest that an adjacent beam would be subject to torsional load that is opposite to the applied load. This is due to the diagonally positioning of the brace, with the first brace pushing against the bottom chord of an adjacent beam due to the compression load applied to its opposite end.

It can also be appreciated that when the beams are subjected to compression or vibrational loading, the struts or braces on both sides of the beam are subjected to similar loads. A load substantially perpendicular to the beams, on the top or bottom chords, would create a compression load to braces on both sides thereof. These compression loads will transfer from the top chord of the first beam to the bottom chord of the adjacent beams. While a tensile load is created from the bottom chord of the first beam to the top chord of the adjacent beams, due to the second set of oppositely angled second braces.

These known systems produce a problem in that these compression and tensile forces created large shear stresses at the fasteners used to attach the braces to the beams and/or to fasteners attached the diagonally orientated first and second braces to each other. Failure is most likely to occur with the fasteners or at these fastening points. In addition to this failure, destructive buckling of the braces can occur due to the opposite compression and tensile loads subjected to braces that are connected together in a diagonal manner. These failures can be catastrophic to building subjected to dynamic loading.

The present invention aims to provide a bridging or bracing system which can be applied in the same manner as are the ordinary wooden braces, to wit, by securing the upper ends prior to the laying of the floor and the lower ends before or after the flooring is secured in position.

While the above-described devices fulfill their respective, particular objectives and requirements, the aforementioned patents do not describe a structural cross bracing system that allows reinforcing and distributing loads between spaced structural members.

Therefore, a need exists for a new and novel structural cross bracing system that can be used for reinforcing and distributing loads between spaced structural members. In this regard, the present invention substantially fulfills this need. In this respect, the structural cross bracing system according to the present invention substantially departs from the conventional concepts and designs of the prior art, and in doing so provides an apparatus primarily developed for the purpose of reinforcing and distributing loads between spaced structural members.

BRIEF SUMMARY OF THE INVENTION

In view of the foregoing disadvantages inherent in the known types of structural reinforcement or bracing systems now present in the prior art, the present invention provides a novel structural cross bracing system, and overcomes the above-mentioned disadvantages and drawbacks of the prior art. As such, the general purpose of the present invention, which will be described subsequently in greater detail, is to provide a new and novel structural cross bracing system and method which has all the advantages of the prior art mentioned heretofore and many novel features that result in a structural cross bracing system which is not anticipated, rendered obvious, suggested, or even implied by the prior art, either alone or in any combination thereof.

To attain this, the present invention essentially includes a bracing system capable of reinforcing at least two structural members. The bracing system can include first and second bracing units each including a connection member featuring at least one connection section and a pair of connection arms extending from the connection section at an angle. At least one end bracket can be located at an end of each of the connection arms, with the end brackets each having a configuration capable of receiving a chord of a structural member. The end brackets of the first bracing unit can be mountable to a first chord of a first structural member and a same first chord of a second structural member. The end brackets of the second bracing unit can be mountable to a second chord of the first structural member and a second chord of a second structural member, such that the connection section of the connection member of the first and second bracing units are adjacent and fastened to each other, and located in an interior space defined between the first and second structural members.

The first chord of the first and second structural members are located on a same side of the first and second structural members, respectively.

The end brackets of each of the first and second bracing units can include a web plate and a side plate extending from the web plate to define an end bracket interior having a configuration capable of receiving the chord of the structural member, respectively.

There has thus been outlined, rather broadly, features of the invention in order that the detailed description thereof that follows may be better understood and in order that the present contribution to the art may be better appreciated.

The connection section of the first and second bracing units can include a flat planar portion orientated in a direction selected from the group consisting of parallel with the web plate, and perpendicular with the web plate.

The connection arms of the first and second bracing units can each include telescoping first and second connection arm sections, thereby allowing the length of the connection arms to be adjusted.

The invention may also include teeth associated with the end brackets for fastening to the first and second structural members, respectively.

The invention may further include at least one connection flange associated with at least one of the end brackets, wherein the connection flange can have a configuration capable of fastening to a connection flange of another bracing unit located adjacent thereto.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of the present invention, but nonetheless illustrative, embodiments of the present invention when taken in conjunction with the accompanying drawings.

As such, those skilled in the art will appreciate that the conception, upon which this disclosure is based, may readily be utilized as a basis for the designing of other structures, methods and systems for carrying out the several purposes of the present invention. It is, therefore, that the claims be regarded as including such equivalent constructions insofar as they do not depart from the spirit and scope of the present invention.

It is therefore an object of the present invention to provide a new and novel structural cross bracing system that has all of the advantages of the prior art structural reinforcement or bracing systems and none of the disadvantages.

It is another object of the present invention to provide a new and novel structural cross bracing system that may be easily and efficiently manufactured and marketed.

An even further object of the present invention is to provide a new and novel structural cross bracing system that has a low cost of manufacture with regard to both materials and labor, and which accordingly is then susceptible of low prices of sale to the consuming public, thereby making such structural cross bracing system economically available to the buying public.

Still another object of the present invention is to provide a new structural cross bracing system that provides in the apparatuses and methods of the prior art some of the advantages thereof, while simultaneously overcoming some of the disadvantages normally associated therewith.

Even still another object of the present invention is to provide a structural cross bracing system for reinforcing and distributing loads between spaced structural members. This allows for increasing the rigidity and load handling capabilities of structural beams using inexpensive bracing units.

Lastly, it is an object of the present invention to provide a new and novel method of using a bracing system for reinforcing at least two structural members. The method can include the steps of mounting end brackets of a first bracing unit to a first chord of spaced apart first and second structural members, such that a connection section of a connection member of the first bracing unit is located in an interior space defined between the first and second structural members. The method can further include the mounting of end brackets of a second bracing unit to a second chord of the spaced apart first and second structural members, such that a connection section of a connection member of the second bracing unit is located in the interior space defined between the first and second structural members and adjacent to the connection section of the first bracing unit. The connection section of the first and second bracing units are then fastened together.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DETAILED DESCRIPTION OF THE INVENTION

Figure 1:
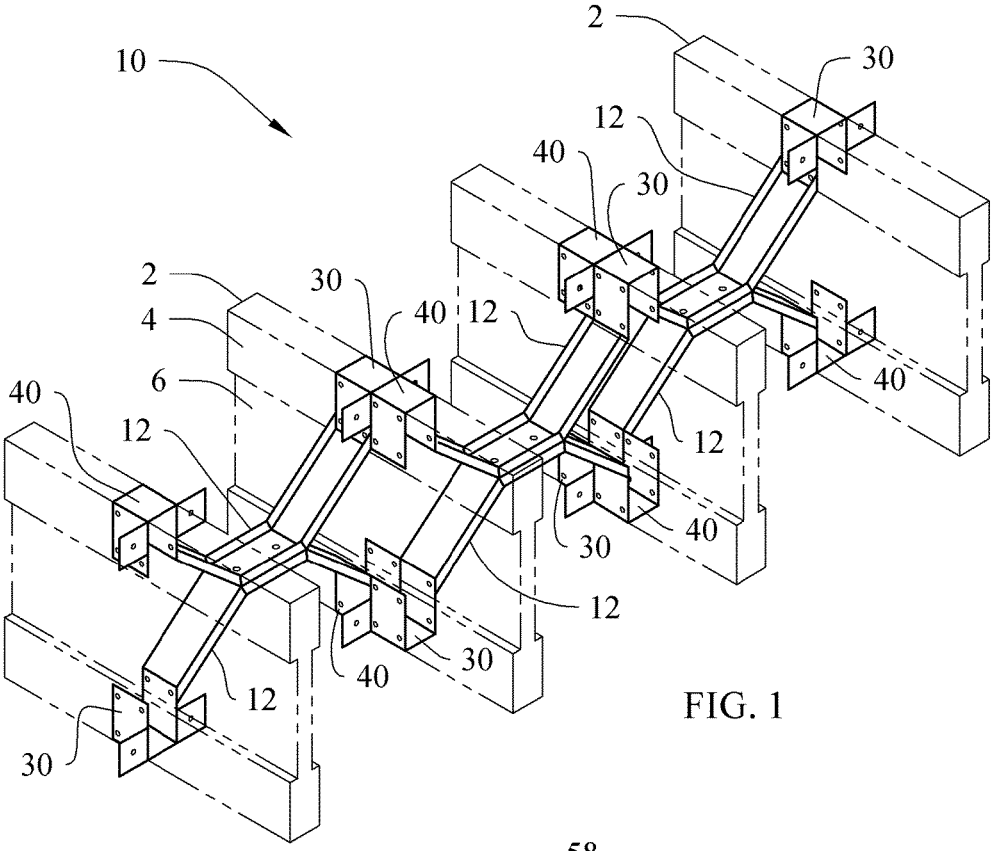
FIG. 1 is a perspective view of an embodiment of the structural cross bracing system constructed in accordance with the principles of the present invention, with the phantom lines depicting environmental structure and forming no part of the claimed invention.

Referring now to the drawings, and particularly to FIGS. 1-15, an embodiment of the structural cross bracing system of the present invention is shown and generally designated by the reference numeral 10.

In FIG. 1, a new and novel structural cross bracing system 10 of the present invention for reinforcing and distributing loads between spaced structural members 2 is illustrated and will be described. More particularly, the structural cross bracing system 10 can include a pair of similar bracing units 12 attached to each other. The structural members 2 can include spaced apart beams featuring a first side or chord 4 and a second side or chord 6. For exemplary description, the structural members 2 can be beams with the first chord 4 being a top chord, and the second chord 6 being a bottom chord of the beam 2, wherein the terms top and bottom should not be directionally limiting. The structural members 2 can be, but not limited to, joists, trusses, studs, I-beams, channeled beams, solid beams, studded walls, foundation elements, deck boards, construction grids, and the like.

The bracing unit 12 can include a rigid connection member 14 and a pair of end brackets being a first end bracket 30 and a second end bracket 40 located at opposite ends of the rigid connection member 14. The system 10 can have a configuration capable of stabilizing and reinforcing spaced apart structural beams 2 according to a first embodiment of the invention. In addition, it is appreciated that the system 10 can increase the structural integrity of floors and ceiling during a fire by connecting not burnt and structurally stable members 2 with unstable members 2. Consequently providing more time for firefighters to battle the fire and/or search for survivors.

A first bracing unit 12 can span between the top chords 4 of spaced apart structural beams 2 and a second inverted bracing unit 12 can span between the bottom chords 6 of the same adjacent structural beams. This pair of bracing units 12 can be utilized together to form the structural cross bracing system 10, with one bracing unit 12 being inverted thereby creating an overall general X-like configuration.

It can be appreciated that multiple successive bracing units can be utilized with each subsequent bracing unit 12 being adjacently offset to its previous bracing unit and in juxtaposition therewith. The use of successive multiple bracing units can allow for a continuous structural cross bracing system 10 along long lengths of many spaced apart beams 2.

Figure 2:
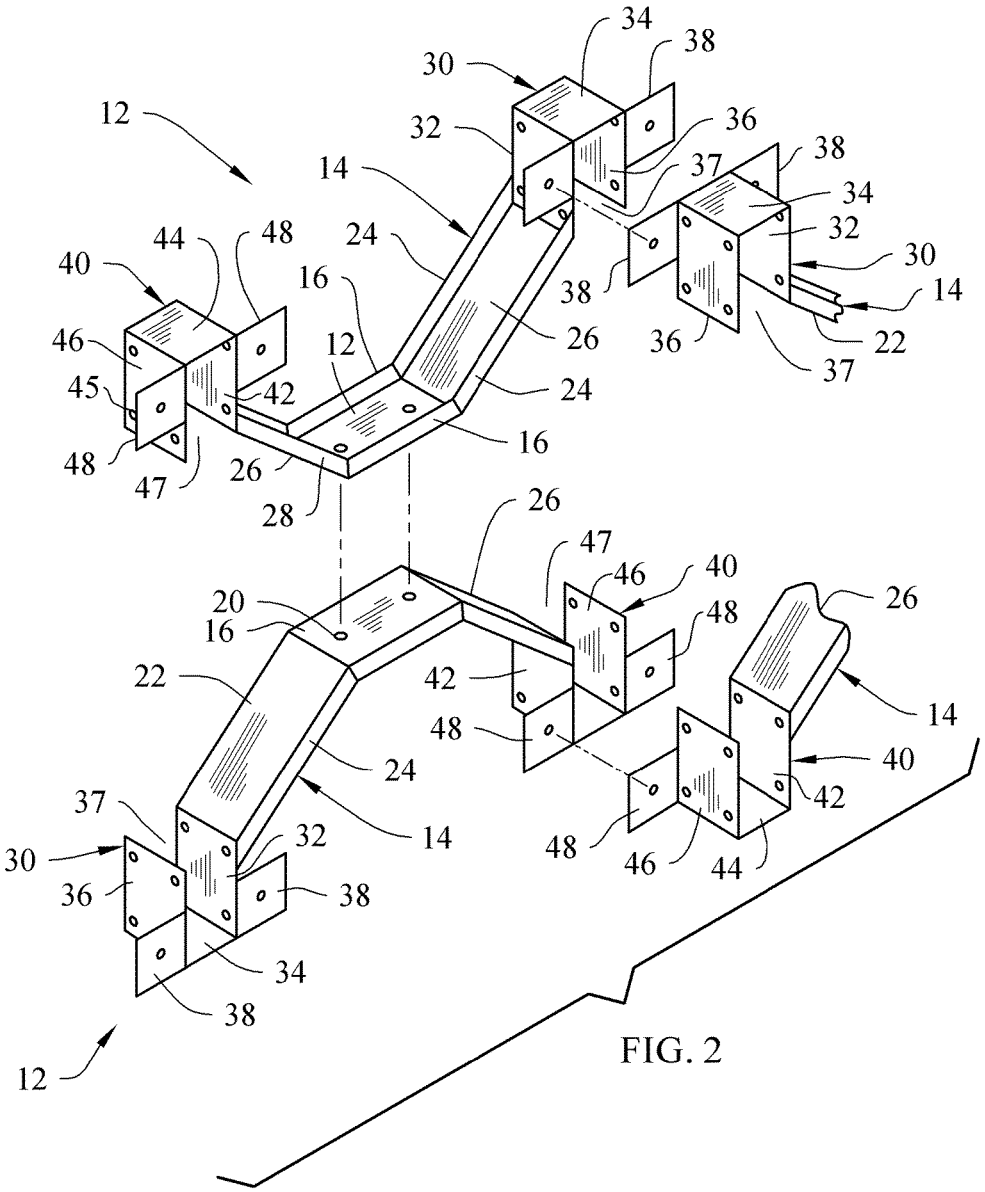
FIG. 2 is an exploded perspective view of the structural cross bracing system of the present invention.
Figure 3:
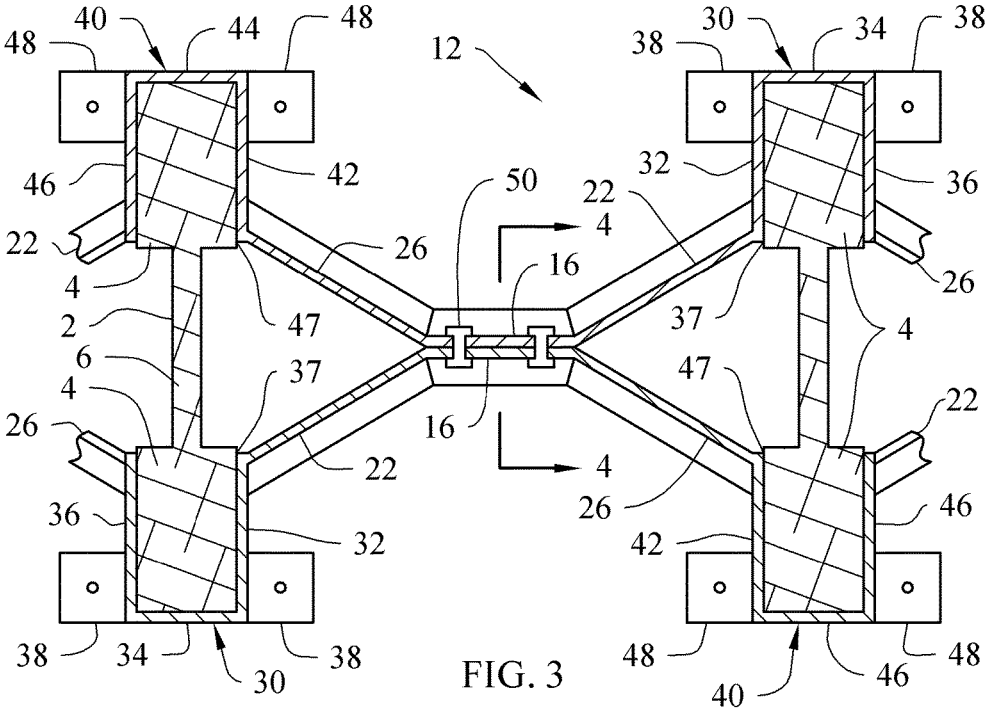
FIG. 3 is a cross-sectional view of the structural cross bracing system secured to adjacent beams.
Figure 4:
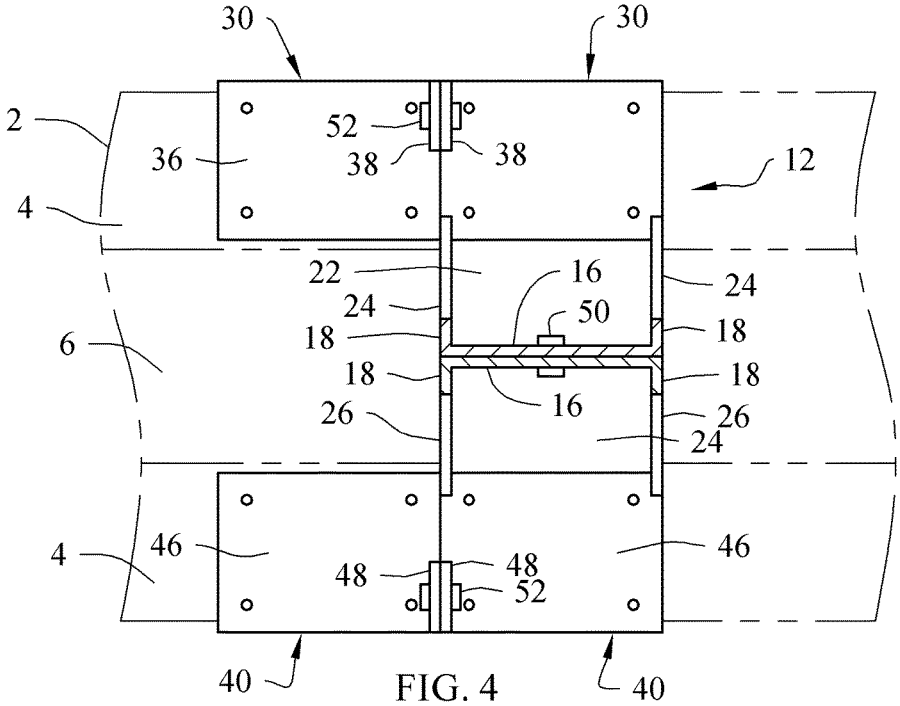
FIG. 4 is a cross-sectional view of the structural cross bracing system taken along line 4-4 in FIG. 3.

Regarding FIGS. 2-4, the bracing unit 12 is illustrated to an embodiment of the present technology. Each bracing unit 12 can include a rigid connection member 14 featuring a connection section or plate 16, a first connection arm 22, a second connection arm 26, a first end bracket 30 and a second end bracket 40. The bracing unit 12 can be made from, but not limited to, metal, composites, plastics, wood and the like. The bracing unit 12 can be formed by bending, welding, extruding, pressing, molding, printing, rolling, fastening and the like. It can be appreciated that any suitable material and/or fabrication methods can be employed with the structural cross bracing system 10.

The connection section 16 can feature a flat planar surface with a pair of opposite side flanges 18. The first connection arm 22 can extend or transition from a first end of the connection section 16 at a predetermined angle. The first connection arm 22 can include a pair of opposite side flanges 24, and can have a longitudinal length that is a planar or arcuate. The second connection arm 26 can extend or transition from a second end of the connection section 16 at a predetermined angle being the same or different from that of the first connection arm 22. The second connection arm 26 can include a pair of opposite side flanges 28, and can have a longitudinal length that is a planar or arcuate. The connection section 16 and/or the connection arms 22, 26, along with their corresponding side flanges can form a generally U-shaped, C-shaped or open channel configuration.

The connection section 16 has a configuration capable of being connected with the connection section 16 of an inverted bracing unit 12, as best illustrated in FIGS. 2 and 3. Mounting bores 20 can be defined through the connection section 16 for mechanically fastening adjacent connection sections 16 together. Such mechanically fastening can be, but not limited to, threaded fasteners, rivets, clips, clamps, latches, locking tabs and the like. It can be appreciated that driving fasteners being driven through their respective connection sections 16, compression fitting, welding or adhesives can be used to secure the connection sections 16.

Located at an end of the first connection arm 22 is the first end bracket 30, and at an end of the second connection arm 26 is the second end bracket 40. The first and second end brackets 30, 40 can have similar configurations that mirror each other. The first and second end brackets 30, 40 can include, respectively, a first side plate 32, 42, a second side bracket 36, 46, and a web plate 34, 44 spanning between the first and second side plates. The first side plate 32, 42 can be rigidly transitioning from or pivotably connected to the ends of their respective first and second connection arms 22, 26. The web plate 34, 44 spans between the first side plate 32, 42 and the second side plate 36, 46 so as to define an open channeled interior 37, 47. Additionally, it can be appreciated that the connection section 16 and the first web plates 34, 44 are parallel with each other.

The channeled interior 37, 47 is capable of receiving the top chord 4, the bottom chord 6 or any part of the beam 2. The first side plate 32, 43, the web plate 34, 44 and/or the second side plate 36, 46 can include at least one mounting bore allowing for a fastener to secure the end brackets 30, 40 with the beams 2, respectively. It can be appreciated that the mounting bore can be eliminated with the use of driving fasteners or other mechanical fastening means.

The end brackets 30, 40 can include at least one connection flange 38, 48 that extends from the first side plate 32, 43, the web plate 34, 44 and/or the second side plate 36, 46, and can include at least one mounting bore. It can be appreciated that the mounting bore can be eliminated with the use of driving fasteners or other mechanical fastening means.

As best illustrated in FIG. 3 and for exemplary description, the first and second end brackets 30, 40 of a first bracing unit 12 can be mounted to the top chords 4 of spaced apart beams 2 so that the connection section 16 is positioned in an interior space defined between the spaced apart beams 2. A second bracing unit 60 can be inverted so that its first and second end brackets 30, 40 can be mounted to the bottom chords 6 of the same spaced apart beams 2 so that its connection section 16 is adjacent to the connection section of the first bracing unit. The now adjacent connection sections 16 can be mounted, fixed, fastened or secured together, to create the structural cross bracing system 10.

An additional structural cross bracing system 10 can be in juxtaposition with an adjacent structural cross bracing system 10, so as to be offset therewith. These additional bracing units can be rotated so that their connection flanges 38, 48 line up and are adjacent with the connection flanges 38, 48 of the juxtaposition bracing unit, as best illustrated in FIG. 4. This can produce successive and continuous structural cross bracing systems 10 with alternating offset bracing units.

It can be further appreciated that the structural members 2 can be a foundation (not shown) and a top chord of a studded wall. The end brackets 30, 40 of the first bracing unit 12 can be configured to receive the top chord of the studded wall, such that the connection member 14 extends down a lateral side of the wall. While the end brackets 30, 40 of the second bracing unit 12 can be configured to be fastened to a top side, a later side or the top and lateral sides of the foundation, such that its connection member 14 extends up the lateral side of the wall so as to be fastened with the connection member of the first bracing unit. In this configuration, the structural cross bracing system can reinforce the spaced apart structural members being the studded wall and the foundation.

Figure 5:
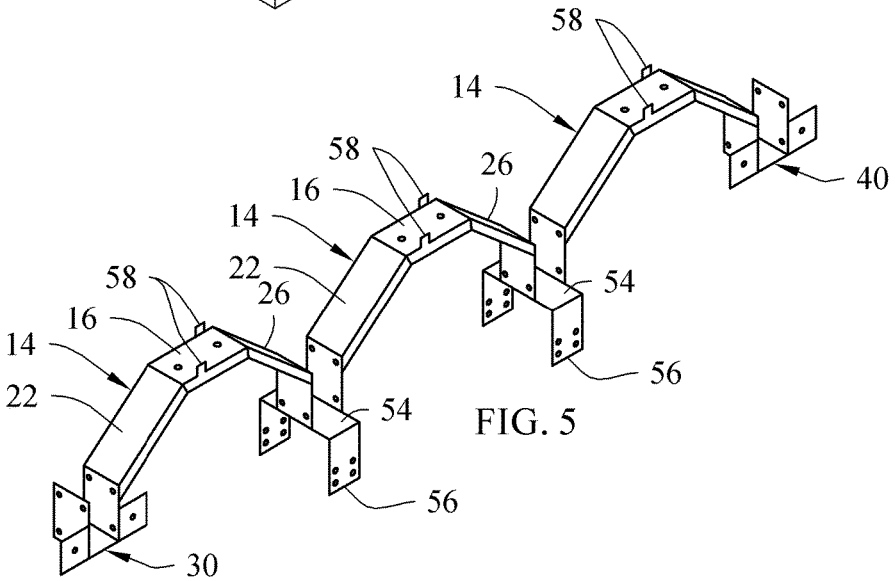
FIG. 5 is a perspective view of a continuous structural cross bracing system including wall web plate tabs and/or wall bottom plate brackets.

FIG. 5 illustrates an alternate embodiment bracing unit, which can include a plurality of successive connection members 14 and intermediate brackets 54. The intermediate brackets 54 can include flanges 56 extending away therefrom. The flanges 56 define a channel interior capable of receiving a longitudinal chord of a studded wall or other structural member. The connection sections 16 of each of the connection members 14 can include a plurality of tabs 58 for retaining the connection section 16 of a fastened inverted bracing unit or a longitudinal chord of a studded wall or other structural member. It is appreciated that any bracing unit of the present technology can use or be modified to use the flanges 56 and/or the tabs 58 alone or in combination with each other.

Figure 6:
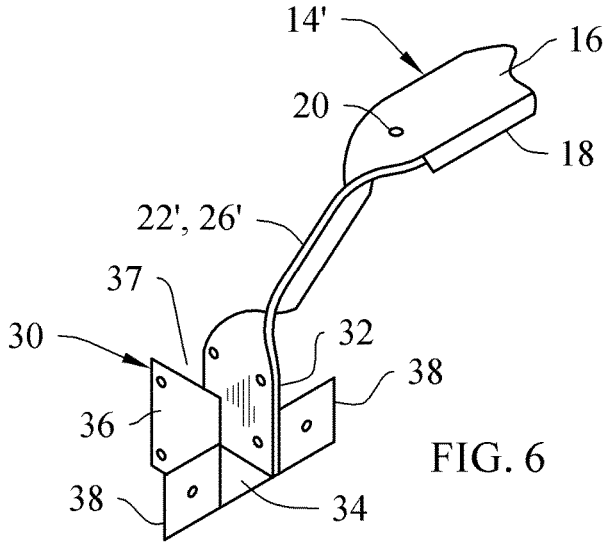
FIG. 6 is a partial perspective view of a twisted connection arm of the structural cross bracing system of the present invention.

Turning to FIG. 6, an alternate embodiment connection member 14' with alternate embodiment first and second connection arms 22', 26' is illustrated. It is appreciated that any bracing unit of the present technology can use or be modified to use the alternate embodiment connection member 14'.

The first and second connection arms 22', 26' transition from the connection section 16 and their respective first side plates 32, 42, and include a twist at each transition. The twist rotates the planar configuration of the first and second connection arms 22', 26' so as to be substantially perpendicular to an orientation of the connection section 16 and the first side plates 32, 42. The perpendicular orientation of the first and second connection arms 22', 26' along or in combination with the twisted transition section, can increase rigidity of the first and second connection arms 22', 26'.

The first and second connection arms 22', 26' may or may not include side flanges, while the connection section 16 may include the side flange 18 to increase rigidity. It can be appreciated that the side flange 18 can also be omitted to assist in manufacturing.

Figure 7:
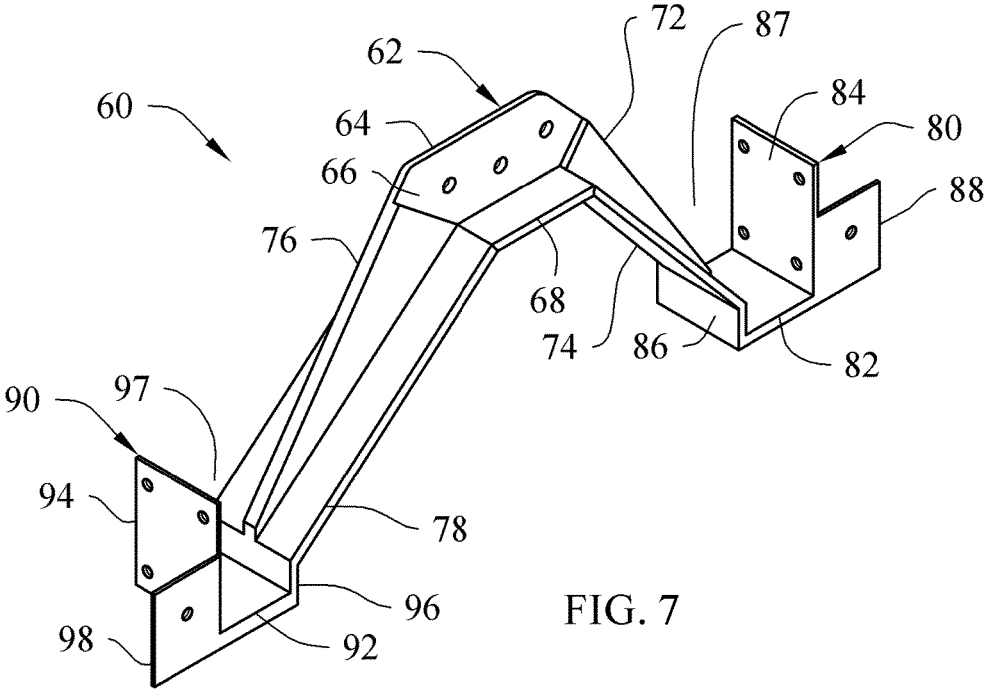
FIG. 7 is a perspective view of a first alternate embodiment of the structural cross bracing system of the present invention.
Figure 8:
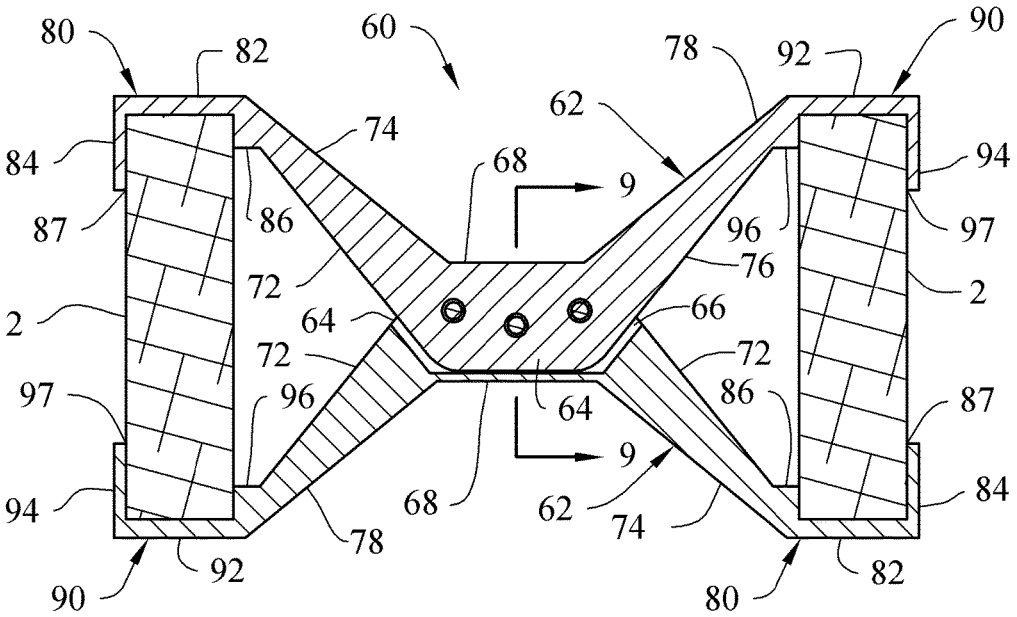
FIG. 8 is a cross-sectional view of the first alternate embodiment structural cross bracing system secured to adjacent beams.
Figure 9:
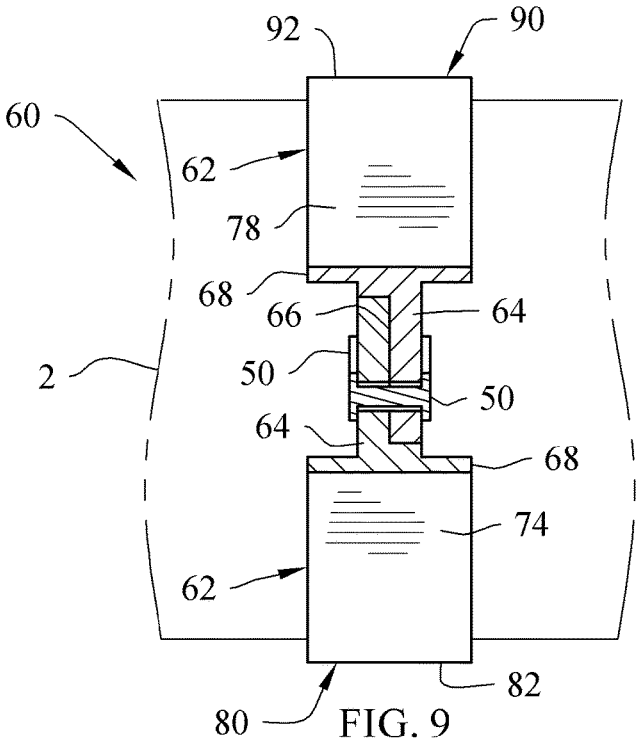
FIG. 9 is a cross-sectional view of the first alternate embodiment structural cross bracing system taken along line 9-9 in FIG. 8.

Regarding FIGS. 7-9, an alternate embodiment bracing unit 60 is illustrated. Each bracing unit 60 can include a rigid connection member 62 featuring a connection section 64, a first connection arm 72, a second connection arm 76, a first end bracket 80 and a second end bracket 90. The bracing unit 60 can be formed from any suitable material and/or fabricated using any suitable fabrication method. It is appreciated that any bracing unit of the present technology can use or be modified to use the alternate embodiment connection member 62.

The connection section 64 can feature a flat planar surface perpendicular to a pair of opposite side flanges 68, with the connection section 64 defining a recess 66 associated with or defined in its flat planar surface. The side flanges 68 and the connection section 64 can form a generally T-shaped configuration. The first connection arm 72 can extend from a first end of the connection section 64 at a predetermined angle. The first connection arm 72 can include a pair of opposite side flanges 74, and can have a longitudinal length that is a planar or arcuate. The second connection arm 76 can extend from a second end of the connection section 64 and a predetermined angle being the same or different from that of the first connection arm 72. The second connection arm 76 can include a pair of opposite side flanges 78, and can have a longitudinal length that is a planar or arcuate. The side flanges 74, 78 and their respective connection arm 72, 76 can form a generally T-shaped configuration.

The side flanges 74, 78 can transition from opposite ends of the side flange 68 of the connection section 64. The recess 66 can be formed in the connection section 64 or can be defined by a thickness of the connection section 64 that is less than a thickness of the ends of the first and second connection arms 72, 76 adjacent thereto.

Located at an end of the first connection arm 72 is the first end bracket 80, and at an end of the second connection arm 76 is the second end bracket 90. The first and second end brackets 80, 90 can have similar configurations that mirror each other. The first and second end brackets 80, 90 can include, respectively, a web plate 82, 92, a side plate 84, 94, and a ledge 86, 96. The web plate 82, 92 can be rigidly transitioning from or pivotably connected to the ends of their respective side flanges 74, 78 of the first and second connection arms 72, 76, or from the ledge 86, 96. The web plate 82, 92 spans between the ledge 86, 96 and the side plate 84, 94 so as to define an open channeled interior 87, 97. Additionally, it can be appreciated that the side flange 68 of the connection section 64 can be parallel with the web plates 82, 92.

The channeled interior 87, 97 is capable of receiving the top chord 4, the bottom chord 6 or any part of the beam 2. The web plate 82, 92, the side plate 84, 94 and/or the ledges 86, 96 can be mounted or fastened to the beams 2 respectively, thereby securing the end brackets 80, 90 and thus the bracing unit 60 to the beams 2.

The bracing unit 60 can include the connection flange 88, 98 that extend from the side plate 84, 94, the web plate 82, 92 and/or the ledges 86, 96. The connection flange 88, 98 allows for a plurality of successive bracing units 60 to be connected together in alternating offset placements.

As best illustrated in FIGS. 8 and 9, a first bracing unit 60 can be mounted to the top chords of spaced apart beams 2 so that the connection section 64 is positioned in the interior spaced defined between the beams 2. A second bracing unit 60 can be inverted and mounted to the bottom chords of the same spaced apart beams 2 so that its connection section 64 is adjacent to the connection section 64 of the first bracing unit 60. The first or second bracing unit 60 can be rotated so that their recess 66 are facing each other. This allows for the connection section 64 of the first and second bracing units 60 to be received in the recess 66 of their corresponding connection section 64, as best illustrated in FIG. 6. When assembled, the combined thickness of the assembled connection section 64 can be equal to the thickness of the first and/or second connection arms 72, 76.

Figures 10A, 10B:
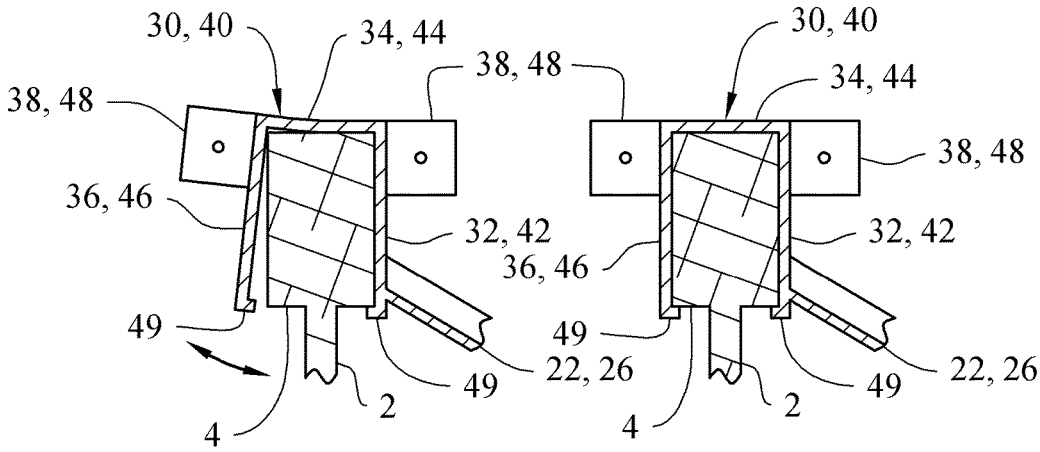
FIG. 10A-10B are cross-sectional views of an alternate embodiment first and second end brackets of the structural cross bracing system.

Turning now to FIGS. 10A and 10B, the end brackets 30, 40 can include a lip 49 extending from an end of the first side plate 32, 42 and the second side plate 36, 46 in a direction toward each other. The lip 49 can extend toward the channeled interior 37, 47 so as to create a stop ledge having a configuration capable of receiving an edge of the top or bottom chord 4, 6 of the beam 2 received in the channeled interior 37, 47. Any bracing unit of the present technology can use or be modified to use end brackets that feature the lip 49. It can be appreciated that the lip 49 can be including with one or both of the side plates.

The flexible nature of the web plate 34, 44 allows for the first and second plates 36, 46 to be moved away from each other, thereby widening the channeled interior 37, 47. Upon widening, the top or bottom chord 4, 6 of the beam 2 can be inserted into the channeled interior 37, 47. After which, the first and second plates 36, 46 can be allowed to return to their original position and toward each other. This will then position the stop edge of the lip 49 against the edge of the top or bottom chord 4, 6 of the beam 2, consequently retaining the top or bottom chord 4, 6 in the channeled interior 37, 47.

Figure 11:
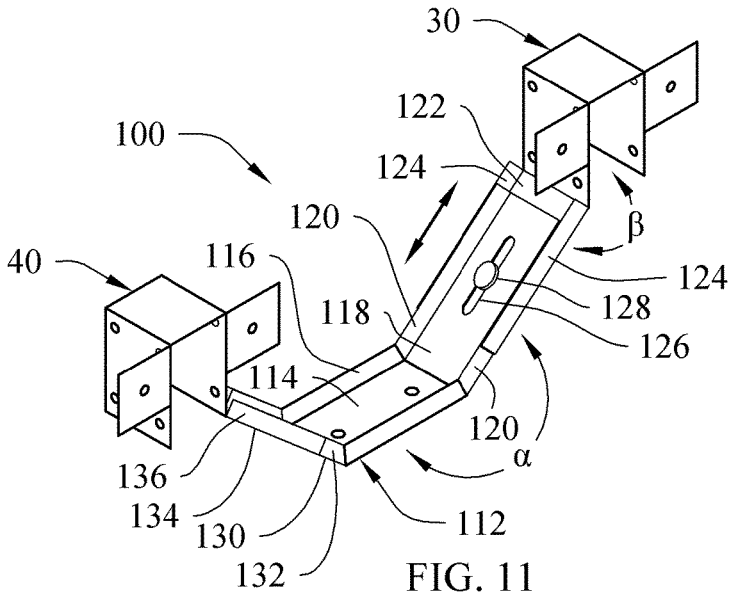
FIG. 11 is a perspective view of an alternate embodiment connection arms of the structural cross bracing system.

Referring to FIG. 11, an alternate embodiment bracing unit 100 including an alternate embodiment connection member 112 is illustrated. Each bracing unit 100 can include a rigid alternate embodiment connection member 112 featuring a connection section 114, a first telescopic connection arm section 118, a second telescopic connection arm section 130, a first end bracket 30 and a second end bracket 40. Any bracing unit of the present technology can use or be modified to use the alternate embodiment connection member 112.

The connection section 114 can feature a flat planar surface with a pair of opposite side flanges 116. The side flanges 116, which are opposite each other, can form a generally U-shaped, C-shaped or open channel configuration. The first telescopic connection arm section 118 can extend from a first end of the connection section 114 at a predetermined angle. The first telescopic connection arm section 118 can include a pair of opposite side flanges 120. It can be appreciated that the first telescopic connection arm section 118 can be pivotably connected to the first end of the connection section 114 allowing angular movement a therebetween.

A first telescopic bracket section 122 can extend from an end of the first side plate 32 of the first end bracket 30 at a predetermined angle toward the first telescopic connection arm section 118. The first telescopic bracket section 122 can include a pair of opposite side flanges 124. It can be appreciated that the first telescopic bracket section 122 can be pivotably connected to the first side plate 32 allowing angular movement B therebetween.

The first telescopic connection arm section 118 and the first telescopic bracket section 122 can be configured to telescopically receive each other, thereby allow the length between the connection section 114 and the first end bracket 30 to be adjusted.

A slot 126 can be defined in the first telescopic connection arm section 118 and the first telescopic bracket section 122, with a fastener 128 passing therethrough to lock the first telescopic connection arm section 118 and the first telescopic bracket section 122 in a desired position and length.

The second telescopic connection arm section 130 can extend from a second end of the connection section 114 at a predetermined angle. The second telescopic connection arm section 130 can include a pair of opposite side flanges 132. It can be appreciated that the second telescopic connection arm section 130 can be pivotably connected to the second end of the connection section 114 allowing angular movement a therebetween.

A second telescopic bracket section 134 can extend from an end of the first side plate 42 of the second end bracket 40 at a predetermined angle toward the second telescopic connection arm section 130. The second telescopic bracket section 134 can include a pair of opposite side flanges 136. It can be appreciated that the second telescopic bracket section 134 can be pivotably connected to the first side plate 42 allowing angular movement B therebetween.

The second telescopic connection arm section 130 and the second telescopic bracket section 134 are configured to telescopically receive each other, thereby allow the length between the connection section 114 and the second end bracket 40 to be adjusted.

A slot can be defined in the second telescopic connection arm section 130 and the second telescopic bracket section 134, with a fastener passing therethrough to lock them in a desired position and length.

The bracing unit 100 is configured so as to be adjustable to allow for use with beams of varying heights and spaced apart distances. This can be accomplished by mounting a first bracing unit 100 to the top chords of spaced apart beams 2 so that the connection section 114 is positioned in the interior space defined between the beams 2. A second bracing unit 100 can be inverted and mounted to the bottom chords of the same spaced apart beams 2 so that its connection section 114 is adjacent to the connection section of the first bracing unit. The first and second telescopic connection arms 118, 122 can be slid in relation to their respective first and second telescopic bracket arms 122, 134 so that adjacent connection sections 112 come in contact with each other. The connection sections 112 can then be fastened together. The pivoting connections associated with angular movements a and B allow for the lateral displacement of the connection section 112. The pivoting connections can be provided by a living hinge or a multi-part hinge system.

Figure 12:
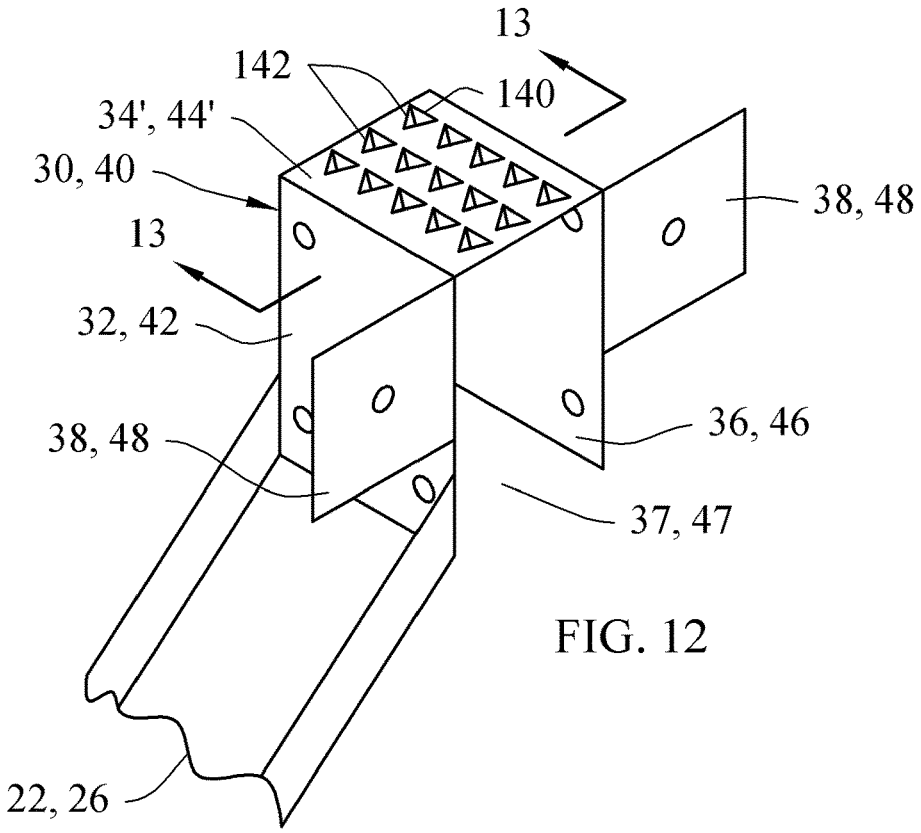
FIG. 12 is a perspective view of an alternate embodiment web plate of the first and second end brackets of the structural cross bracing system.
Figure 13:
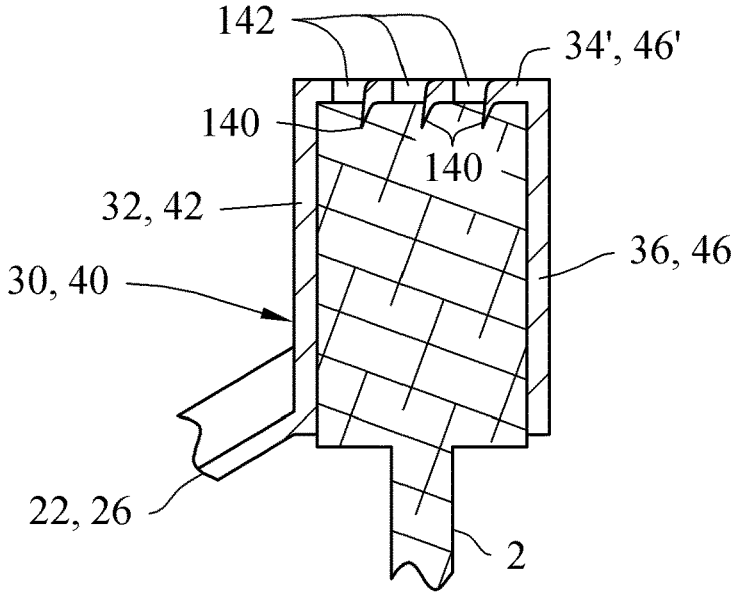
FIG. 13 is a cross-sectional view of the alternate embodiment web plate of the first and second end brackets taken along line 13-13 in FIG. 12.

Turning now to FIGS. 12 and 13, an alternate embodiment web plate 34', 44' is illustrated. Any of the end brackets of the present technology can include the alternate embodiment web plate 34', 44', which includes a plurality of teeth 140 having a configuration capable of being driven or impaled into the top chord, the bottom chord or any part of the beam 2. The teeth 140 can be formed by deforming or cutting teeth shaped members from the web plate 34', 44' toward their respective channeled interior 37, 47, which thus defines openings 142 in the web plate 34', 44', as best illustrated in FIG. 13.

The end bracket 30, 40 can be mounted on the beam 2, then the web plate 34', 44' can be pressed or hammered so that the teeth 140 are driven into the beam 2. This will secure the end bracket 30, 40 to the beam 2. It can be appreciated that the teeth 140 can be formed in the web plate, the first side plate and/or the second side plate of the end brackets.

Figure 14:
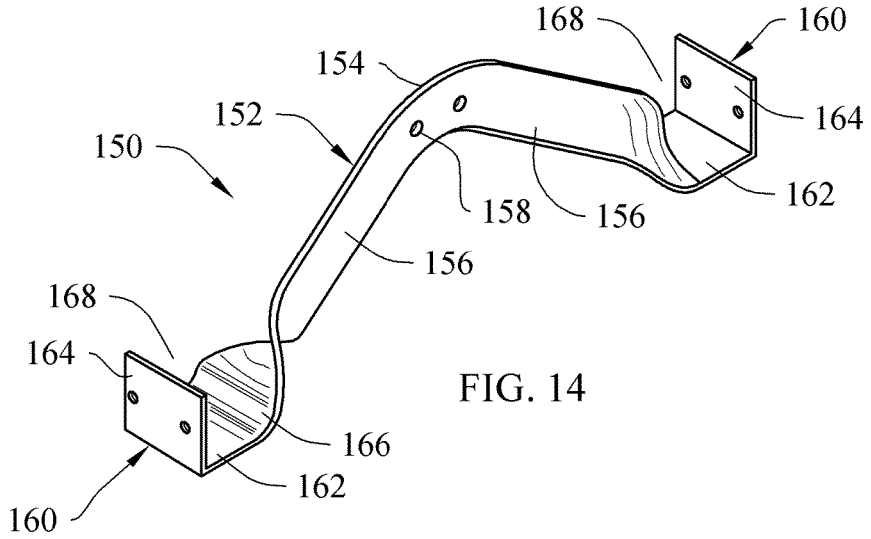
FIG. 14 is a perspective view of a second alternate embodiment of the structural cross bracing system of the present invention.
Figure 15:
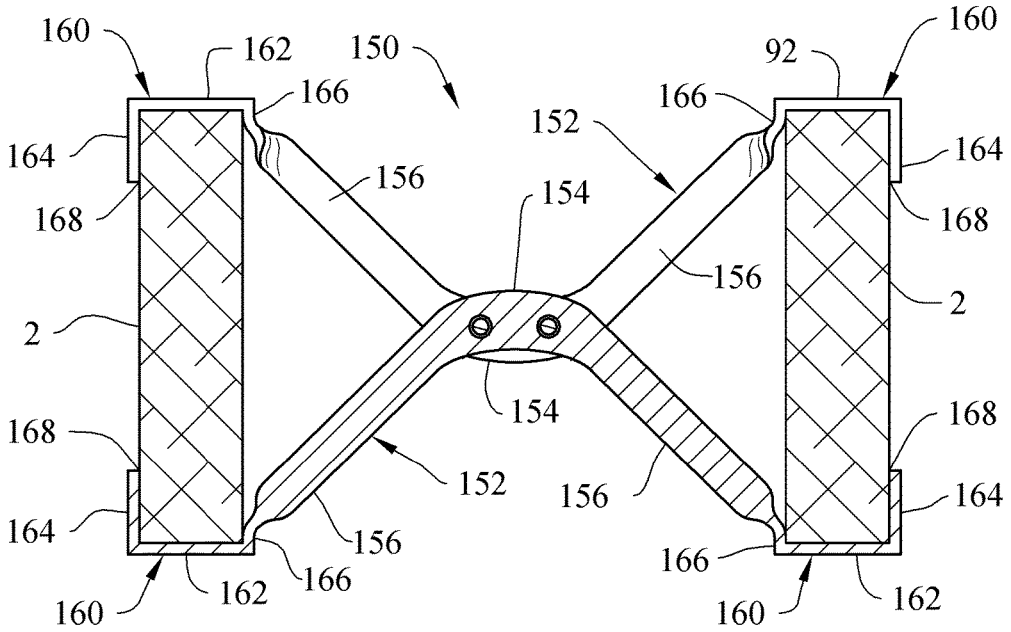
FIG. 15 is a cross-sectional view of the second alternate embodiment connection member of the structural cross bracing system of the present invention.

Regarding FIGS. 14 and 15, an alternate embodiment bracing unit 150 is illustrated. Each bracing unit 150 can include a rigid connection member 152 featuring a top connection section 154, a pair of connection arm sections 156, and a pair of end brackets 160. The bracing unit 150 can be formed from any suitable material and/or fabricated using any suitable fabrication method.

Each end bracket 160 can include a web plate 162, a side plate 164, and a ledge 166. Optionally, each end bracket 160 can further include at least one connection flange. The web plate 162 can be rigidly transitioning from or pivotably connected to ends of their respective connection arm section 156. The top connection section 162 spans between the side plate 164 and the ledge 166 so as to define an open channeled interior 168.

The channeled interior 168 is capable of receiving the top chord, the bottom chord or any part of the beam 2. The web plate 162, the side plate 164 and/or the ledge 166 can be mounted or fastened to the beams 2 respectively, thereby securing the end brackets 160 and thus the bracing unit 150 to the beams 2.

The connection arm sections 156 are oriented at an angle with the top connection section 154, and transition from their respective web plate 162 and/or ledge 166 by way of a twist. The twist rotates the planar configuration of the connection arm sections 156 and top connection section 154 so as to be substantially perpendicular to an orientation of the web plate 162 and/or the ledge 166. The perpendicular orientation of the connection arm sections 156 and top connection section 154 along or in combination with the twisted transition section, can increase rigidity of the connection arm sections 156.

As best illustrated in FIG. 15, a first bracing unit 150 can be mounted to the top chords of spaced apart beams 2 so that the top connection section 154 is positioned in the interior space defined between the beams 2. A second bracing unit 150 can be inverted and mounted to the bottom chords of the same spaced apart beams 2 so that its top connection section 154 is adjacent to the top connection section of the first bracing unit. This adjacent positioning of the top connection section 154 of the first and second bracing units 150 allows them to be fastened or secured together.

It can be appreciated that the connection member, connection arms and/or connection sections of the present technology can have a cross-section profile being a C-shaped channel, a U-shaped channel, a box channel, a tube, a T-shape, a H-shape, a L-shape, an I-shape or a flat web. Furthermore, the connection member, connection arms and/or connection sections of the present technology can be provided with longitudinal and/or lateral ridges, ribs, corrugations, geometrically shaped profiles and the like to increase strength and rigidity, with or without corresponding side flanges.

It can further be appreciated that the distance between a center of the end and/or intermediate brackets of the bracing unit can be predetermined and manufactured to meet construction or bylaw requirements relating to the center-to-center distance of the beams. This could provide quicker installation of the beams in that a bottom bracing unit can be positioned with its end bracket channeled interiors facing upward. Then a beam can be positioned in each of the end and/or intermediate brackets, resulting in the required center-to-center distance of the beams without measuring out the distance between each beam installation. This would decrease installation time of joists, beams, trusses, studs and the like.

In use, it can now be understood that any bracing unit of the present technology can be utilized with a corresponding inverted bracing unit to form the structural cross bracing system 10 of the present invention. In exemplary operation, a first bracing unit can be located at a desired location on the spaced apart beams. The first bracing unit can be positioned on the beams by moving or sliding its end brackets in a direction toward the beam such that the desired location of the beams are received by the channeled interior of the end brackets, respectively. The connection member is consequently positioned in the interior space defined between the spaced apart beams.

A second bracing unit can then be located on the same beams at the same desired location as the first bracing unit, but in an inverted orientation. The second bracing unit can be positioned on the beams by moving or sliding its end brackets in a direction toward the beam such that the desired location of the beams are received by the channeled interior of the end brackets, respectively.

The second bracing unit is positioned such that the connection section of the first and second bracing units are adjacent each other in a way capable for allowing them to be fastened together. The adjacent connection sections can then be fixed together to form a rigid structural cross bracing system 10.

Thereafter, subsequent first and second bracing units can be placed in succession to provide a single row of bracing units. It can be appreciated that the subsequent bracing units can be offset from the previous bracing units, such that any connection flanges are adjacent to each other for assembly. Fasteners can be passed through any plates of the end brackets so as to secure the bracing units to their respective beams.

It can be understood that the assembled first and inverted second bracing units have a configuration capable of distributing a compressing or tensioning load force associated with their connection arms without creating or limiting a shearing force between the fastened connection sections.

Although the description above is in reference to beams, it will be appreciated that the structural cross bracing system 10 may also be applicable to other structural members as well. These structural members can be, but not limited to, adjacent wall studs, studded walls, framed walls, foundation elements, deck boards, structural grids or any parallel structural members or framing. It will be appreciated that it might be necessary to alter the lengths, widths, heights, thicknesses and/or angles of any of the plates and/or members of the bracing unit.

While embodiments of the structural cross bracing system have been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material may be used instead of the above-described. And although reinforcing and distributing loads between spaced structural members have been described, it should be appreciated that the structural cross bracing system herein described is also suitable for absorbing vibrational forces or assisting in the installation of structural beams.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bracing system for reinforcing at least two structural members, said bracing system comprising:

at least two bracing units including a first bracing unit and at least one second bracing unit, said bracing units each comprising a connection member including at least one connection section and at least two connection arms each extending from said connection section at an angle, and at least one end bracket located at an end of each of said connection arms, said end bracket each having a configuration capable of receiving a side of a structural member;

wherein said end bracket of said first bracing unit being mountable to a first side of a first structural member and a first side of a second structural member, and said end bracket of said second bracing unit being mountable to a second side of the first structural member and a second side of a second structural member, such that said connection section of said first and second bracing units are fastened to each other and are located in an interior space defined between the first and second structural members;

wherein the first side of the first and second structural members are located on a same side of the first and second structural members, respectively.

2. The bracing system of claim 1, wherein said end bracket of said bracing units each including a web plate and a side plate extending from said web plate to define an end bracket interior having a configuration capable of receiving the side of the structural member, respectively.

3. The bracing system of claim 2, wherein said end bracket of said bracing units each further including a second side plate extending from said web plate in a spaced apart relationship with said side plate.

4. The bracing system of claim 2, wherein said connection section of said bracing units each has a flat planar portion orientated in a direction selected from the group consisting of parallel with said web plate, and perpendicular with said web plate.

5. The bracing system of claim 4, wherein said flat planar portion of said bracing units are fastened together.

6. The bracing system of claim 2, wherein said connection arms of said bracing units each has a cross-sectional profile selected from the group consisting of a C-shaped channel, a U-shaped channel, a T-shape, a H-shape, a L-shape, an I-shape, and a flat web.

7. The bracing system of claim 1, wherein said connection arms of said bracing units each comprises telescoping first and second connection arm sections having a configuration capable of adjusting a length of said connection arms, respectively.

8. The bracing system of claim 2, wherein said web plate and/or the side plate of said end bracket includes teeth having a configuration capable of fastening to the first and second structural members, respectively.

9. The bracing system of claim 1, wherein at least one of said end bracket of said bracing units further comprises at least one connection flange having a configuration capable of fastening to a connection flange of another bracing unit located adjacent thereto.

10. The bracing system of claim 1, wherein said connection arms of said first and second bracing units further comprises a side flange extending from opposite sides of said connection arms.

11. The bracing system of claim 1, wherein said connection section of said first and second bracing units further comprises a side flange extending from opposite sides of said connection section.

12. The bracing system of claim 1, wherein said end bracket are rigidly or pivotably connected to said connection arms, respectively.

13. The bracing system of claim 1, wherein said end bracket are integrally formed with said connection member.

14. The bracing system of claim 1, wherein said first and second bracing units each include a plurality of successively alternating connection members and end brackets.

15. The bracing system of claim 14, wherein a distance between each of said successively alternating end brackets are equal.

16. The bracing system of claim 14, wherein at least one of said end bracket includes at least one flange having a configuration capable of mounting to a third structural member.

17. The bracing system of claim 16, wherein said flange defines a flange interior capable of receiving the third structural member, wherein said flange interior has a longitudinal axis perpendicular to a longitudinal axis of an end bracket interior defined by said end bracket.

* * * * *